US006102200A

United States Patent [19]

Dressen et al.

[11] Patent Number: 6,102,200

[45] Date of Patent: Aug. 15, 2000

[54] SECURITY PACKAGE WITH ASYMMETRIC LOCK

[75] Inventors: Larry G. Dressen, Waconia; Stanley P. Buisman, Brooklyn Park; Roger H. Ricketts, Apple Valley, all of Minn.

[73] Assignee: Emplast, Inc., Waconia, Minn.

[21] Appl. No.: 09/389,571

[22] Filed: Sep. 3, 1999

[51] Int. Cl.[7] ..... B65D 85/672; E05B 65/00

[52] U.S. Cl. ..... 206/308.2; 206/387.11

[58] Field of Search ..... 206/308.2, 387.11, 206/1.5, 309, 308.1, 807

[56] References Cited

U.S. PATENT DOCUMENTS

| | | | |
|---|---|---|---|
| 4,865,190 | 9/1989 | Gregerson et al. | 206/309 |
| 5,375,712 | 12/1994 | Weisburn | 206/387.11 |
| 5,601,188 | 2/1997 | Dressen et al. | 206/308.2 |
| 5,934,114 | 8/1999 | Weisburn et al. | 206/308.2 |

*Primary Examiner*—Jacob K. Ackun
*Attorney, Agent, or Firm*—Nokolai, Mersereau & Dietz, P.A.

[57] ABSTRACT

A security package for use in retail establishments to lock in articles which are for sale in a clear plastic case which is larger than the article displayed for sale and which optionally has enclosed an electronic article surveillance tag to prevent shoplifting. The security package has a locking mechanism built into the case which can not be opened without a key. The locking mechanism comprises a pair of asymmetric tines which are on opposite sides of an asymmetric engagement member. To lock the security package the asymmetric engagement member spreads apart the asymmetric tines until the asymmetric engagement member gets passed the asymmetric tines. The asymmetric tines close behind the asymmetric engagement member and lock the asymmetric engagement member in place. The asymmetric tines must be separated by an asymmetric key to allow the asymmetric engagement member to pass by the asymmetric tines to unlock the security package. The asymmetric tines and the asymmetric engagement member are shaped to prevent tampering with the locking mechanism and making the security package harder to open without a complimentary asymmetrically shaped key. The security package also has an inside wall and an outside wall on the top portion and a middle wall in the bottom portion for placement between the inside and outside walls when the security package is closed, which prevents sideways motion of the top and bottom portions of the security package to further thwart tampering with the security package.

12 Claims, 8 Drawing Sheets

SECURITY PACKAGE WITH ASYMMETRIC LOCK

BACKGROUND OF THE INVENTION

I. Field of the Invention

The present invention relates generally to a security package for audio cassettes, video cassettes, compact discs, and the like. More particularly, the present invention relates to a security package having an asymmetric locking mechanism capable of securely encompassing such audio-visual articles within the security package, as well as an internally disposed electronic article surveillance (EAS) tag therewithin and a asymmetric key for the locking mechanism.

II. Discussion of the Prior Art

In an effort to thwart or eliminate the theft of audio cassettes, video cassettes, compact discs, and the like, retailers have for years worked toward producing packages for such articles having improved security characteristics. Due to the relatively compact size of such audio-visual articles, many of the anti-theft efforts to date have focused upon securing the audio-visual article within a housing or package of increased size. The increased size of the security package, it is found, presents a potential thief with greater difficulty in concealing the security package during flight from the premises. While effectively reducing the degree to which such audio-visual articles are stolen, a significant number of audio cassettes, video cassettes, compact discs, and the like still fall victim to cunning shoplifters who successfully secrete and abscond with such prior art security packages notwithstanding the increased size. Due to the high prices of such audio-visual articles, these losses become expensive for retailers and are significant even if only a few are stolen per month.

To further reduce the likelihood of thievery, some of the aforementioned prior art security packages include electronic article surveillance (EAS) tags disposed within the security package so that an alarm will sound within the retail store if a thief attempts to leave the premises without having the store clerk remove or disable the EAS tag.

The security packages must be opened and the article sold removed at the checkout counter prior to the customer leaving the store such that the EAS does not sound. Some thieves have found means to open the security packages and remove the articles such that they can be stolen easier. A security package with a secure lock which can be easily opened with the proper key but hard to open by other means, is needed by the retail industry. The security package should be made with a see through material to allow a customer to view the article to be purchased and read the labels thereon.

One such prior art security package is disclosed in U.S. Pat. No. Des 343,356 to Wittman, which shows a see through security package with a locking mechanism.

U.S. Pat. No. 4,865,190 to Gregerson et al and U.S. Pat. No. 5,601,188 to Dressen et al. both show a symmetric locking mechanism which can be relatively easily opened by some thieves.

SUMMARY OF THE INVENTION

The present invention, provides a see-through security package with an asymmetric locking mechanism which is difficult to open without an asymmetric key and which resists opening by other means. The side panels of the security package overlap and will bind together when moved sideways such that it is difficult to pry the security package open the a screwdriver, knife or other implement.

The security package has a top portion and a bottom portion attached by a hinge at one end for ease of opening and closing the security package. The opposite ends of the top and bottom of the security package have engagement member pods and tine pods respectively for forming the locking mechanism. The tine member pod has at least two opposing tines, one on each side of the engaging member. The engagement member is shaped such that the tines will slip over the engaging member when closing the security package. When the security package is closed the tines will be positioned under the engagement member locking the security package. A key is necessary to move the tines out from under the engagement member to open the package. The engagement members, tines and keys all have asymmetric shapes to deter unauthorized opening of the security packages. The asymmetric tines compliment the shape of the asymmetric engagement portion for easy of closing the locking mechanism, and for opening it with the asymmetric key.

The pods have walls which restrict access to the tines to prevent opening of the security package with a implement other than a key.

OBJECTS OF THE INVENTION

It is accordingly a principal object of the present invention to provide an improved security package for audio cassettes, video cassettes, compact discs, and the like.

It is a further object of the present invention to provide a relatively inexpensive lockable security package that can be used in conjunction with retailers' present electronic anti-theft alarm activators.

It is a further object of the present invention to provide a lockable security package compatible with having an EAS tag therein.

It is yet another object of the invention to provide an asymmetric locking mechanism.

It is also an object of the invention to prevent unauthorized opening of the security package by limiting the side movement of the security package walls.

It is an object of the invention to provide an asymmetric key for opening the asymmetric locking mechanism.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
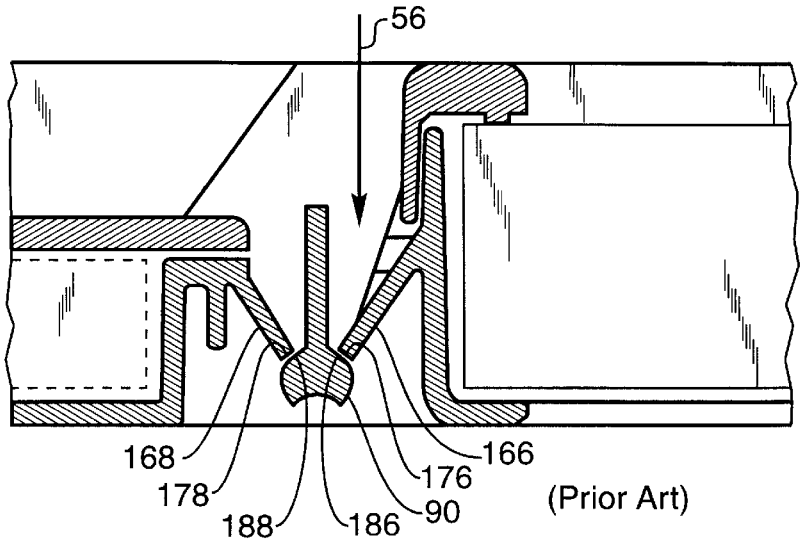
FIG. 1 is a side view of a symmetric locking mechanism of the prior art.

FIG. 1 shows a side view of a prior art symmetric locking mechanism. The locking mechanism comprises an engagement member 90 and angled tine members 166, 168. The engagement member 90 is shown with beveled surfaces 186, 188. The angled tine members 166 and 168 have engagement surfaces 176, 178 which when adjacent the beveled surfaces 186, 188, of the engagement member 90 prevent opening of the locking mechanism. The entirety of the engagement surfaces 176, 178 engage the beveled surfaces 186, 188 such that the angled tine members 166, 168 must be displaced a large distance to clear the engagement member 90 to unlock the locking mechanism. The engagement aperture 56 allows a key to be inserted to unlock the locking mechanism by spreading the angled tine members 166, 168 out and away from the engagement member 90 such that the locking mechanism is unlocked.

Figure 2:
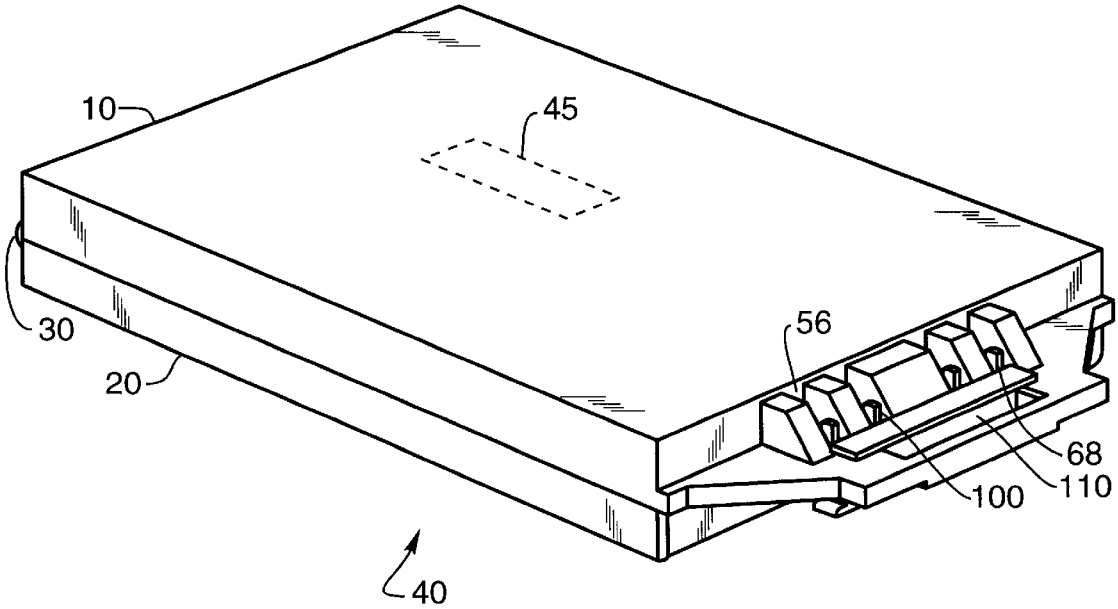
FIG. 2 is a schematic view of a closed security package with a locking mechanism.
Figure 3:
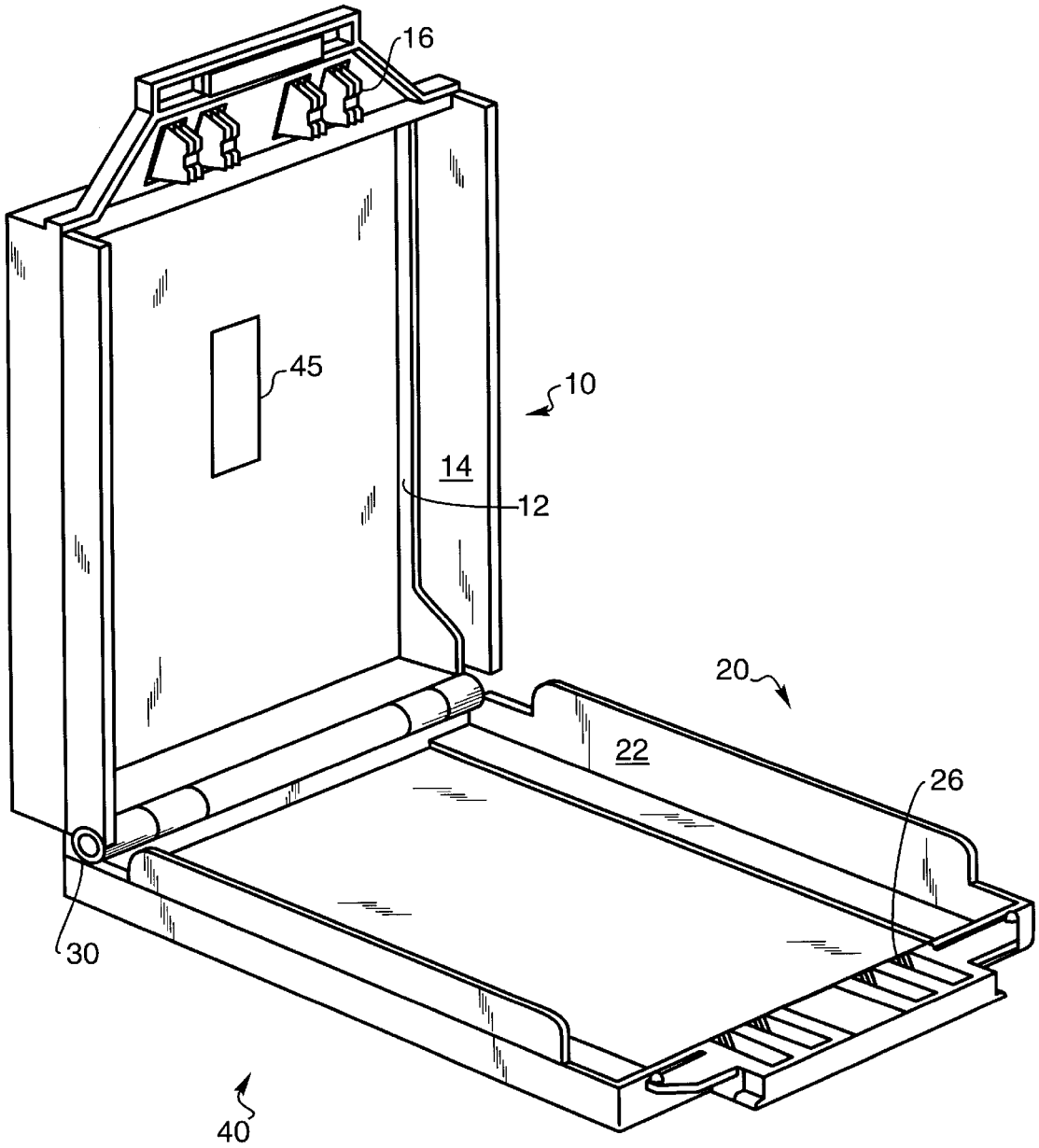
FIG. 3 is a schematic view of an open security package with a locking mechanism.

FIG. 2 shows the security package 40 locked. The top portion 10 of the security package 40 and the bottom portion 20 of the security package 40 are adjacent and the lock mechanism 100 is engaged in the locked position. An electronic article surveillance tag 45 is inside of the security package 40 on the top portion 10. FIG. 3 shows the security package 40 opened with hinge 30 pivoting the top portion 10 and the bottom portion 20 relative to each other to open and close the security package 40. FIG. 3 shows the engagement member pod 16 and the tine member pod 26. When the engagement member pod 16 and the tine member pod 26 are overlapping in a closed position the security package 40 is locked as in FIG. 2.

Figure 4:
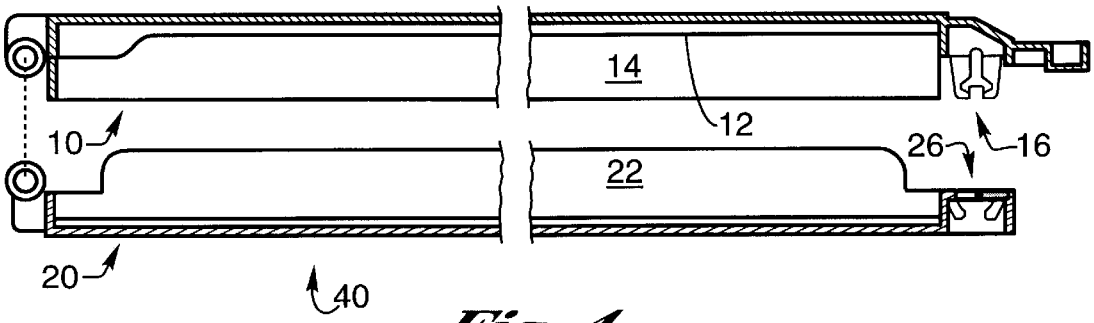
FIG. 4 is a side view of an open security package with a locking mechanism.

FIGS. 3 and 4 show the double wall feature which helps secure the security package 40 against tampering to open the security package. The top portion 10 has an inside wall 12 and an outside wall 14. The bottom portion 20 has a middle wall 22, which fits snuggly between the inside wall 12 and an outside wall 14. If someone tries to open the security package 40 by prying on the outside wall 14, it will push the outside wall into contact with the middle wall 22 which is limited in movement by the inside wall 12. The outside 14 wall being in contact with the middle wall 22 prevents further movement of the walls and prevents the security package 40 from being opened by prying with a sideways motion.

Figure 5:
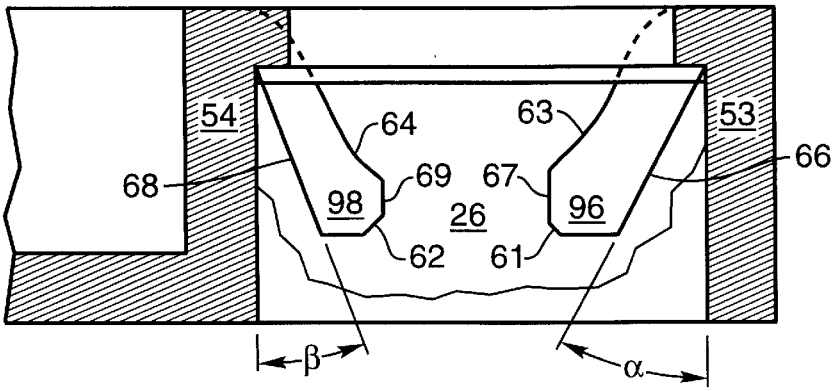
FIG. 5 is a side view of the angled tine members.

FIG. 5 shows a side view of a portion of a tine member pod 26 with a left tine member 66 and a right tine member 68. It should be noted that the left tine member base portion 96 is thicker at the than the rest of the tine. The time members 66, 68 are deflected by a portion of the angles $\alpha$ and $\beta$ of the left tine member 66 and the right tine member 68 respectively relative to the right and left pod walls 53, 54 in order to move the tine members 66, 68 to lock and unlock the locking mechanism 100. It should be noted that the left tine member base portion 96 is thicker at the than the rest of the left tine member 66. Similarly the right tine member base portion 98 is thicker at the than the rest of the tine member 68.

Figure 6:
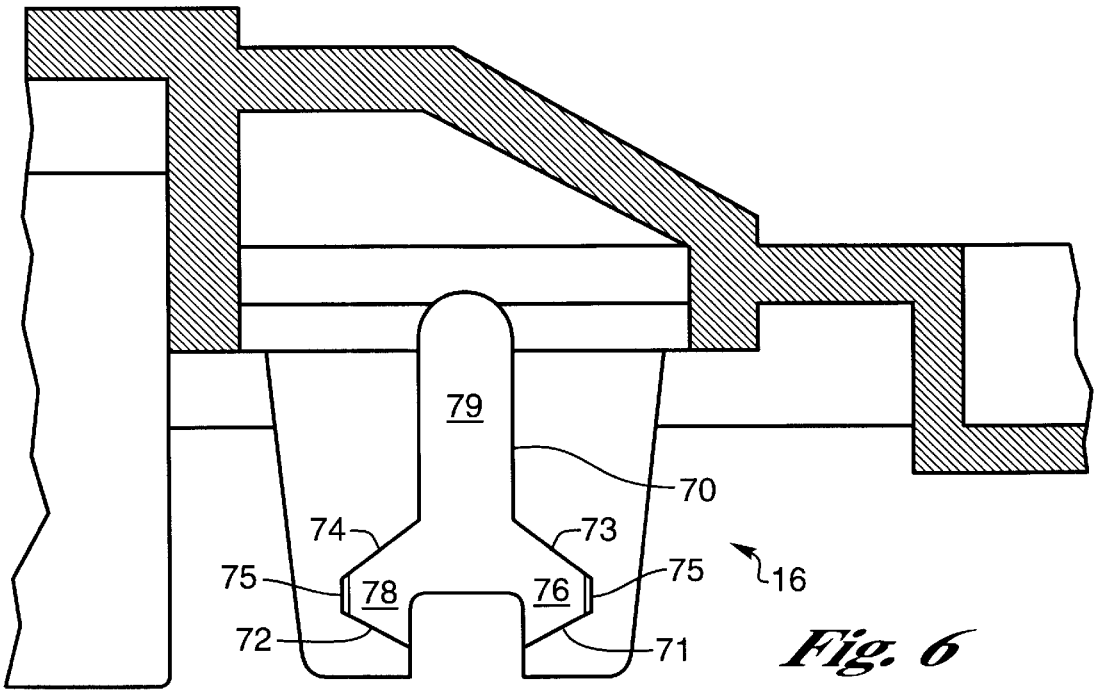
FIG. 6 is a side view of the engagement member.

FIG. 6 shows a side view of the asymmetric engagement member 70 in engagement member pod 16. The asymmetric engagement member 70 has a left engagement member portion 76 and a right engagement portion 78 which have left and right angled top portions 71 and 72 respectively left and right angled bottom portions 73 and 74. The angled portions 71, 72, 73, 74 of the asymmetric engagement member 70 all have different angles. The asymmetric engagement member also has a trunk portion 79.

Figure 7:
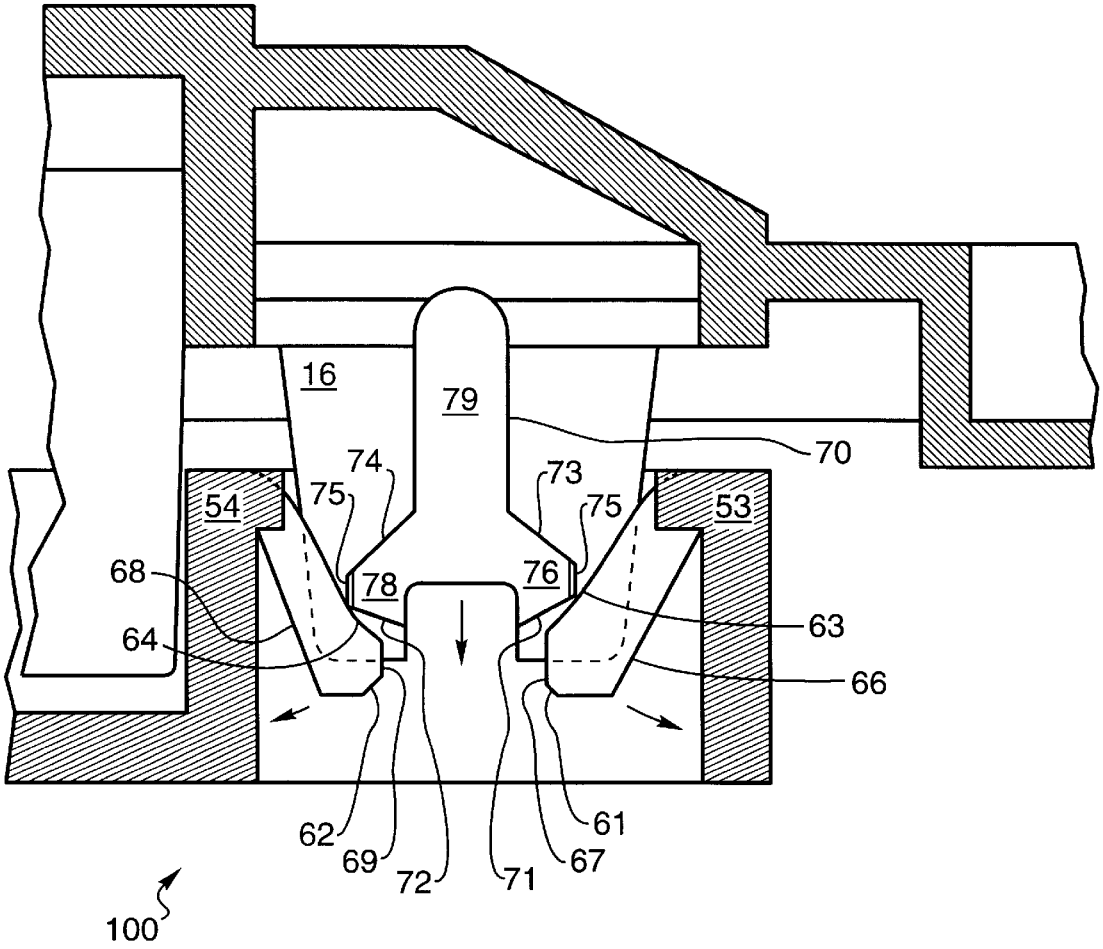
FIG. 7 is a side view of the angled tine member proximate the engagement member prior to being locked.

FIG. 7 shows a side view of the lock mechanism 100 with the asymmetric engagement member 70 moving upward in the figure so as to lock the security package 40. The asymmetric engagement member 70 will push apart the left and right tine members 66 and 68 by contact with the junction of parallel portions 75 and angled top portions 71, 72. Then the parallel portions 67, 69 of the left and right tine members 66, 68 will engage the parallel portions 75 of the asymmetric engagement member 70 to let the asymmetric engagement member 70 pass by the left and right tine members 66, 68.

Figure 8:
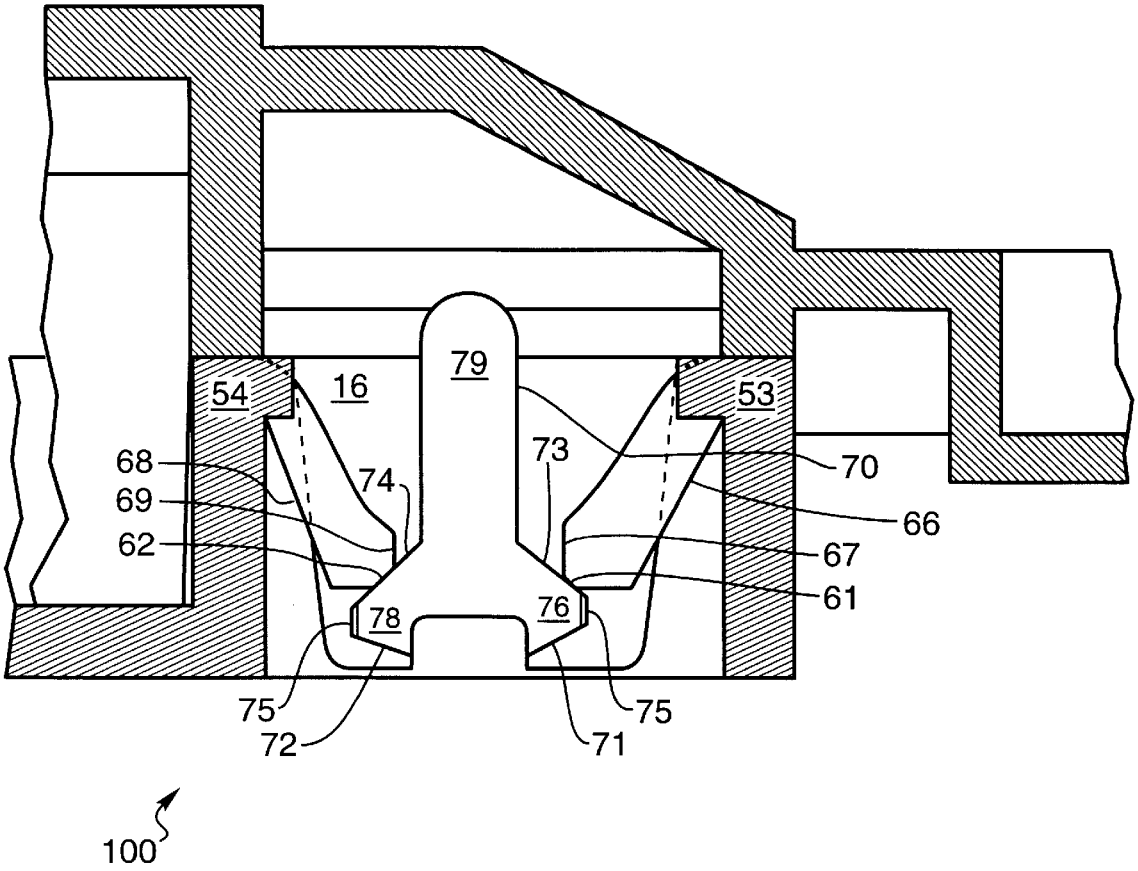
FIG. 8 is a side view of the angled tine member proximate the engagement member in the locked position.

After the left and right tine members 66, 68 pass the top of the asymmetric engagement member 70, the locking mechanism 100 is in the locked position as shown in FIG. 8, wherein the engaging surfaces 61 and 62 of the left and right time members 66 and 68 are adjacent the angled bottom portions 73, 74 of the left and right engagement members portions 76, 78. The angles of the surfaces match for parallel engagement such that the asymmetric engagement member 70 can not be withdrawn from the locking mechanism without spreading apart the left and right tine members 66, 68.

Figure 9:
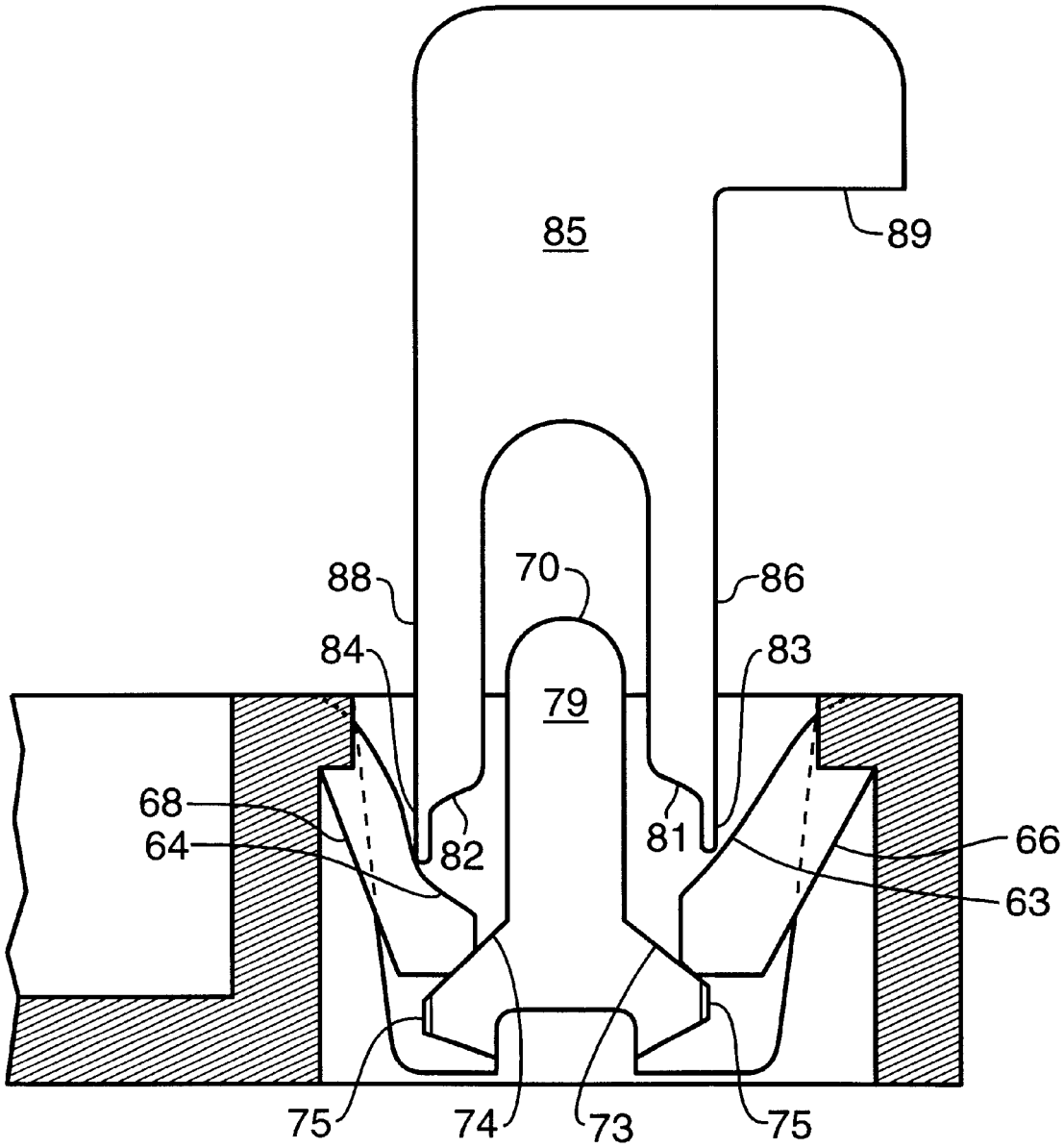
FIG. 9 is a side view of the angled tine member proximate the engagement member in the locked position with an asymmetric key for opening the asymmetric locking mechanism.
Figure 10:
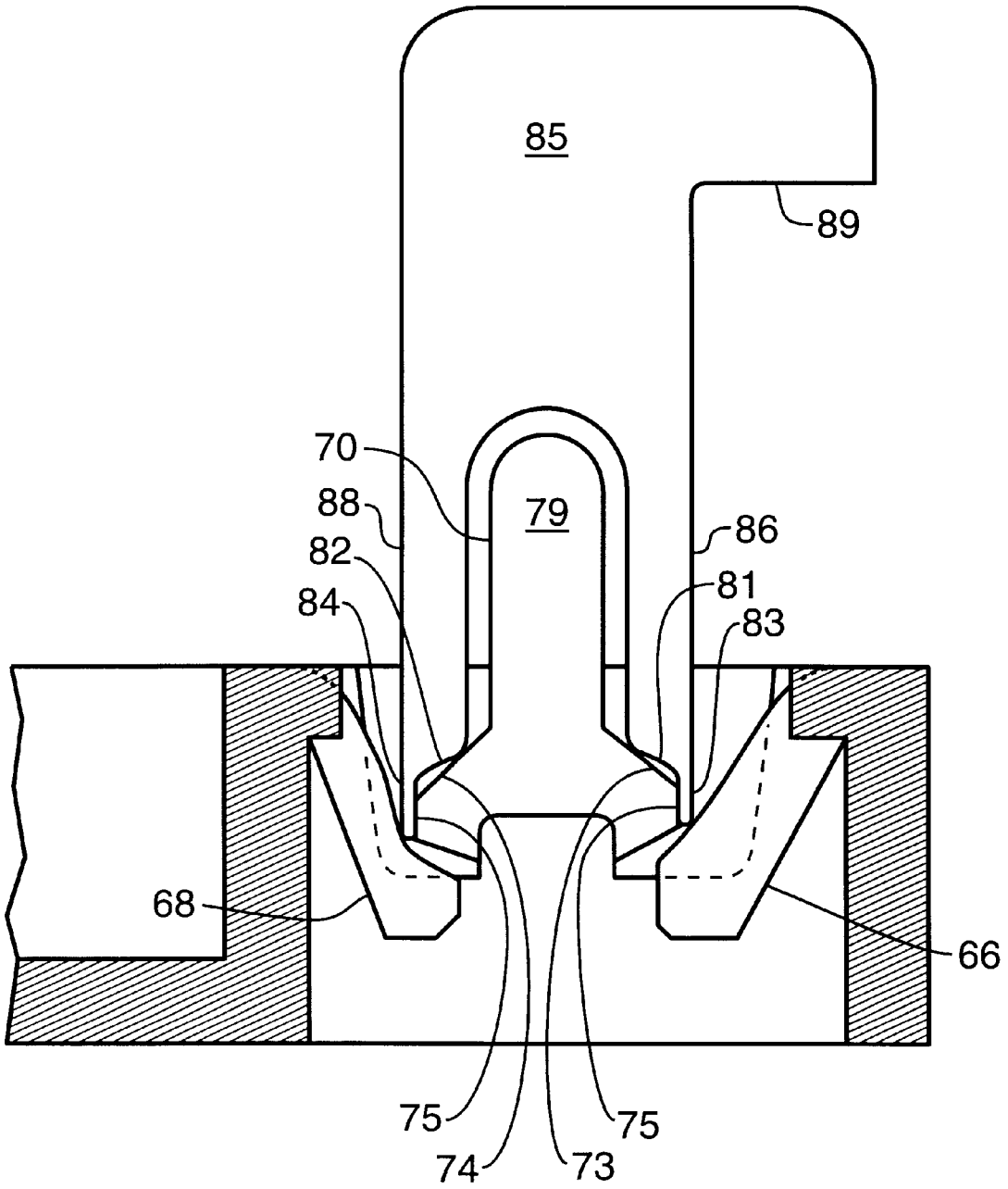
FIG. 10 is a side view of the asymmetric key proximate the engagement member unlocking the security package.
Figure 11:
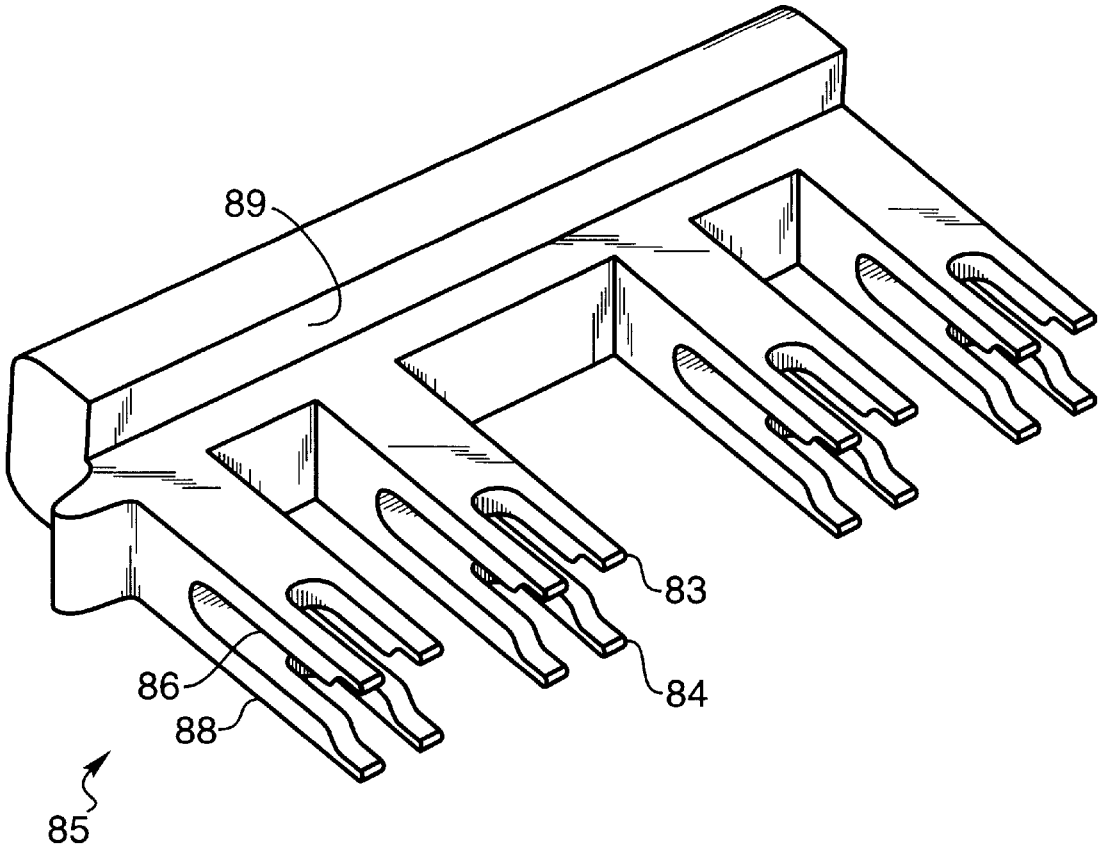
FIG. 11 is a perspective view of the asymmetric key.

In order to unlock the locking mechanism 100 an asymmetric key 85 is required. The key must be inserted into the engagement aperture 56 (FIG. 1) created by the pod walls which restrict access to the tines 66, 68. FIG. 9 shows an asymmetric key 85 unlocking the locking mechanism 100 by the key arms 86, 88 pushing aside the left and right tine members 66, 68 by contacting them on the angled surfaces 63, 64 with the tip portions 83, 84 of key arms 86, 88. In FIGS. 9 and 10 it is seen that the key 85 is shaped like the asymmetric engagement member 70 wherein the angles 81, 82 on the key arms 86, 88 match the angles of the angle bottom portion 73, 74 of the asymmetric engagement member 70. The trunk 79 of the engagement member 70 fits into the asymmetric key 85 between the arms 86, 88 and restricts access to the tines 66, 68 by other objects which may be used to try to open the security package 40. As the key 85 pushes the left and right time members 66, 68 back, the tip portions 83, 84 are adjacent parallel portions 75 of the left and right engagement member portions 76, 78 and the left and right tine members spring back to their rest positions in the unlocked configuration above the asymmetric engagement portion 70.

The matching asymmetry of the key 85 the asymmetric engagement member 70 and the left and right tine members 66, 68 are a security feature as a symmetric key will not work with the other asymmetric parts. However it should be noted that the asymmetric key will work with and unlock the prior art devices as shown in FIG. 1. Therefore one key will unlock both types of security packages.

The plateau 89 of the asymmetric key 85 tells the user which way the asymmetric key 85 fits in the engagement aperture 56 as seen in FIG. 2. The plateau 89 of the asymmetric key 85 will be adjacent the plateau portion 110 of the security package 40 when the key is properly inserted in the engagement aperture 56 to operate the lock mechanism 100.

Obviously, many modifications and variations of the present invention are possible in light of the above teachings. It is therefore to be understood that, within the scope of the appended claims, the invention may be practiced otherwise than as specifically described.

What is claimed is:

1. An anti-theft security package comprising:

a top portion having at least one engagement member pod and a hinge, a bottom portion having at least one tine member pod and a hinge for pivotal connection to the top portion, the at least one engagement member pod and the at least one tine member pod engage each other to form a locking mechanism, the engagement member pod having at least one asymmetric engagement member, the tine member pod having at least one left tine member and an opposing right tine member the opposing tine members are asymmetric for complimenting the asymmetric form of the asymmetric engagement members, the base of the left member tine is thicker than the rest of the tine and the base of the right member tine is thicker then the rest of the tine.

2. An anti-theft security package as in claim 1 further comprising:

the at least one asymmetric engagement member having a left engagement member portion and a right engagement member portion which are asymmetric.

3. An anti-theft security package as in claim 2 further comprising:

an angled top portion of the left engagement member portion and an angled top portion of the right engagement member portion having different angles such that the left and right engagement member portions are asymmetric.

4. An anti-theft security package as in claim 2 further comprising:

an angled and an angled bottom portion of the right engagement member having different angles such that the left and right engagement member portions are asymmetric.

5. An anti-theft security package as in claim 3 further comprising:

an angled bottom portion of the left engagement member and an angled bottom portion of the right engagement member having different angles such that the left and right engagement member portions are asymmetric.

6. An anti-theft security package as in claim 4 further comprising:

the left tine member has an engaging surface angled for engaging the angled bottom portion of the left engagement member and the right tine member has an engaging surface angled for engaging the angled bottom portion of the right engagement member.

7. An anti-theft security package as in claim 5 further comprising:

the left tine member has an engaging surface angled for engaging the angled bottom portion of the left engagement member and the right tine member has an engaging surface angled for engaging the angled bottom portion of the right engagement member.

8. An anti-theft security package as in claim 2 further comprising:

wherein the left engagement member portion and a right engagement member portion have a parallel portion and the left tine member and right tine member both have a parallel surface for slideably engaging the engagement member portion parallel portion such that the engagement portion can pass by the tines when the tines are fully extended.

9. An anti-theft security package as in claim 7 further comprising:

wherein the left engagement member portion and a right engagement member portion have a parallel portion and the left tine member and right tine member both have a parallel surface for slideably engaging the engagement member portion parallel portion such that the engagement portion can pass by the tines when the tines are fully extended.

10. An anti-theft security package as in claim 1 further comprising:

an asymmetric key having at least one left arm portion and at least one right arm portion with the left and right arm portions being asymmetric for complimenting the left and right sides of the at least one asymmetric engagement members in an engagement pod.

11. An anti-theft security package as in claim 10 further comprising:

wherein the left engagement member portion and a right engagement member portion have a parallel portion and, the left arm portion and he right arm portion both have a tip portion adjacent the parallel portions of the right and left engagement member portions respectively when the key is fully inserted on the asymmetric engagement member.

12. An anti-theft security package as in claim 1 further comprising:

the top portion having an inside wall and an outside wall along the sides of the security package, and the bottom portion having a middle wall between the inside wall and the outside wall on the sides of the security package for limiting the side to side movement of the top portion of the security package relative the bottom portion.

* * * * *